United States Patent [19]

Sage et al.

[11] Patent Number: 4,565,139

[45] Date of Patent: Jan. 21, 1986

[54] METHOD AND APPARATUS FOR OBTAINING ENERGY

[75] Inventors: Warnie L. Sage, Littleton; Thomas E. Stringfellow, Aurora, both of Colo.

[73] Assignee: Stearns Catalytic World Corp., Denver, Colo.

[21] Appl. No.: 649,558

[22] Filed: Sep. 12, 1984

[51] Int. Cl.[4] ..... F23D 1/00

[52] U.S. Cl. ..... 110/347; 110/244; 110/245; 110/263; 122/4 D

[58] Field of Search ..... 110/347, 263, 244, 245; 122/4 D

[56] References Cited

U.S. PATENT DOCUMENTS

| | | | |
|---|---|---|---|
| 4,397,248 | 8/1983 | Mehta et al. | 110/263 |
| 4,475,472 | 10/1984 | Adrian et al. | 110/347 |
| 4,485,747 | 12/1984 | Pershing et al. | 110/347 |

*Primary Examiner*—Edward G. Favors

*Attorney, Agent, or Firm*—Mark L. Rodgers; E. Eugene Innis; James C. Simmons

[57] ABSTRACT

A low BTU, low volatile content, low carbon and high ash fuel is combusted in a combined shaft kiln combustor and fluidized bed combustor to generate heat which is converted to useful energy. The fluidized bed combustor is mounted vertically above the shaft kiln combustor. A venturi is provided in a passageway connecting the shaft kiln combustor and the fluidized bed combustor to produce a gaseous stream moving at a velocity sufficient to separate finer particles from the low BTU, low volatile content, low carbon and high ash fuel so that the coarser particles are burned in the shaft kiln combustor and the finer particles are burned in the fluidized bed combustor.

19 Claims, 1 Drawing Figure

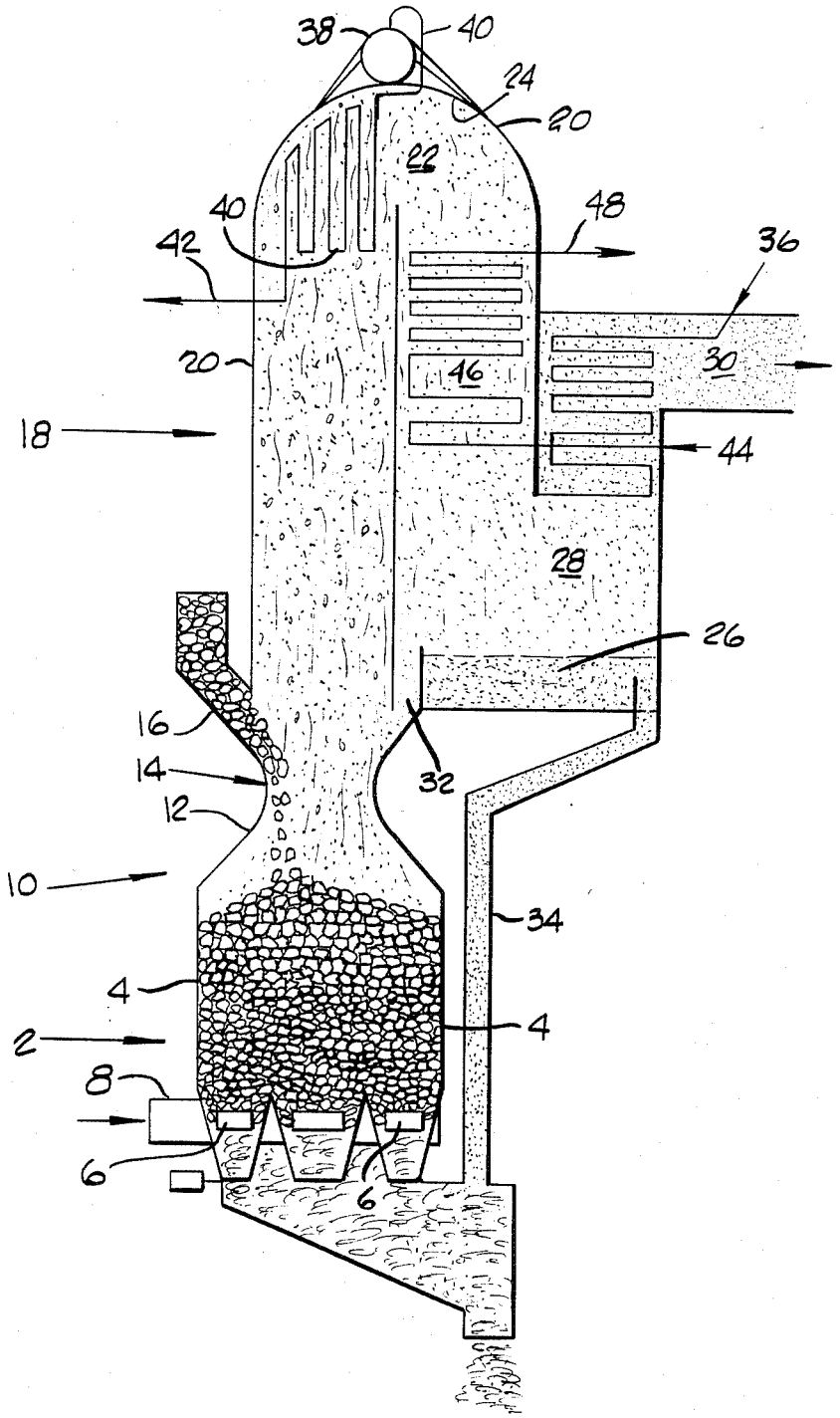
38
40
24
20
22
40
48
42
36
20
46
30
18
44
28
26
16
14
32
12
10
34
4
4
2
8
6
6

METHOD AND APPARATUS FOR OBTAINING ENERGY

FIELD OF THE INVENTION

This invention relates to the obtaining of energy by a combustion process and in particular to obtaining energy from low BTU, low volatile content, low carbon and high ash fuels which in the preferred embodiment of the invention comprises spent shale.

BACKGROUND INFORMATION

The processing of oil shale to obtain usable oil products has increased in recent years as oil shale has become a more feasible source of energy. In conjunction with the processing of the oil shale, one of the end products generated is spent shale. Spent shale can be defined as including the characteristics of a low BTU, low volatile content, low carbon, high ash fuel. Spent shale typically comprises a wide range of particle sizes, e.g. fines to three inches. Because useful energy remains in spent shale, it would be desirable to be able to utilize that energy. However, known combusting systems are not able efficiently to handle and to combust the spent shale because of the relatively wide range of spent shale particle sizes.

In known entrained or fluidized bed combustors, relatively small particles (less than one inch) are effectively handled but such combustors are inadequate for relatively larger particles. In another known type of combustor, relatively large particles (1–4 inches) are combusted but such a system cannot tolerate any significant amount of smaller sized particles or fines due to the unacceptably high pressure drop created by such particles.

In order to treat the spent shale to obtain useful energy therefrom, it has been necessary first to separate the spent shale particles into large and small size particles before introducing the separated larger particles into a combustor adapted to handle such particles and separately introducing the smaller particles into another combustor adapted to handle these smaller particles and fines. Alternatively, it has been suggested to subject the larger particles to a grinding operation so that smaller size particles are formed. However, any separation process involves additional processing time and results in further expense without any energy being obtained during this process step. The grinding operation is also disadvantageous. Because the spent shale is generated at a relatively high temperature (800° F.), the grinding step causes a substantial removal of heat from the spent shale by contact with the grinding equipment. Since it is highly desirable to maintain the spent shale at this high temperature, the grinding operation results in a wasteful loss of heat.

Because of the foregoing problems associated with obtaining energy from spent shale, it is not uncommon simply to dispose of the spent shale, instead of trying to obtain any further useful energy therefrom. Even this disposal process has drawbacks due to the high temperature of the generated spent shale and the handling thereof, as well as the considerable quantities of the spent shale generated during the processing of oil shale. As a consequence, an apparatus and method which economically and efficiently combusts different size particles of spent shale, without the loss of substantial heat present in the generated spent shale, would provide significant benefits over known systems.

SUMMARY OF THE INVENTION

This invention provides a method and apparatus for obtaining energy from low BTU, low volatile content, low carbon and high ash fuels, such as spent shale.

The process of this invention is directed to the combustion of low value fuel to obtain energy therefrom as described above, particularly spent shale, which is generally obtained at a high temperature, e.g. from about 800° to about 900° F. Typically, a material of this type is comprised of particles ranging from fines (i.e. less than about 0.01 inch) up to about 3 to 4 inches. The process of this invention comprises introducing this low value fuel into a fuel inlet zone disposed intermediate and intercommunicating between a fuel inlet end of a first combustion zone having both a fuel inlet end and a combusted fuel outlet end, and a fuel inlet end of a second combustion zone also having a fuel inlet end and a combusted fuel outlet end. An oxygen-containing gas is introduced into the first combustion zone at the combusted fuel outlet end thereof and the gas is flowed sequentially through the first combustion zone, out of the fuel inlet end of the first combustion zone, through the fuel inlet zone, into the fuel inlet end of the second combustion zone, through the second combustion zone and out the outlet end of the second combustion zone. The flow rate and velocity of the gas flowing through the fuel inlet zone and the second combustion zone is controlled so as to separate finer particles (e.g. having a size up to about $\frac{1}{4}$ or $\frac{3}{8}$ inch) from coarser particles having a size up to about 3 to 4 inches), and to entrain the finer particles and to carry such entrained particles into the inlet end of the second combustion zone, through the second combustion zone and out the outlet end of the second combustion zone. The finer particles are combusted in the second combustion zone, and heat is recovered therefrom. The coarser particles are passed to and introduced into the first combustion zone through the fuel inlet end thereof. The coarser particles are combusted in the first combustion zone and heat is recovered therefrom. Finally, combusted coarser particles are removed from the outlet end of the first combustion zone, while combusted finer particles are removed from the outlet end of the second combustion zone.

In a preferred mode of operation, the velocity of the oxygen-containing gas flowing through the first combustion zone is relatively low, and the velocity of the gas is increased in the fuel inlet zone to a level sufficient to separate and to entrain the finer particles. It has also been found convenient to locate the second combustion zone at an elevation greater than the first combustion zone, preferably vertically above the first combustion zone, and to pass the coarser particles from the fuel inlet zone to the first combustion zone by means of gravity.

In a preferred embodiment of the invention, a combination of a shaft kiln combustor and a fluidized bed combustor is used wherein the fluidized bed combustor is mounted vertically above the shaft kiln combustor. The top or fuel inlet/gas exit end of the shaft kiln combustor is connected to the bottom or fuel inlet/entrance end of the fluidized bed combustor by means forming a passageway therebetween. Inlet means are provided in the passageway for the introduction of all of the fuel or spent shale. Separation of the spent shale into finer particles and coarser particles is achieved in the passageway. The finer particles are combusted in the fluidized bed combustor and the coarser particles are combusted in the shaft kiln combustor. In the preferred method and apparatus of this invention, the spent shale is utilized while still at high temperatures, such as above 800° F.

In the preferred embodiment of the invention, the separation of the fuel or spent shale into finer particles and coarser particles is accomplished using a moving stream of gaseous products in the passageway between the shaft kiln combustor and the fluidized bed combustor. The moving stream has a velocity such that when quantities of the spent shale are introduced into the passageway, the finer particles, up to about ¼ inch in size, will move with the moving stream into the fluidized bed combustor. The coarser particles, above about ⅜ inch in size will pass through the passageway into the shaft kiln combustor. In the preferred embodiment, the velocity of the moving stream is generated by providing a venturi in the passageway. The moving stream of gaseous products comprises a mixture of air and combustion gases exiting from the shaft kiln combustor which are accelerated to the desired velocity while passing through the venturi. Also, the exit end of the venturi leading to the fluidized bed combustor is significantly smaller than the entrance end of the venturi adjacent the shaft kiln combustor so that the velocity of the gaseous stream moving through the fluidized bed combustor is sufficient to carry the finer particles therewith for combustion in the fluidized bed combustor. Means are provided to utilize the heat generated in the shaft kiln combustor and the fluidized bed combustor to heat a fluid to recover energy. In the preferred embodiment, the fluid is water and the energy is in the form of steam. While the preferred embodiment uses spent shale as the fuel, it is to be understood that the method and apparatus of this invention can be used with many types of low BTU, low volatile content, low carbon and high ash fuels.

Other features and advantages of the invention will be apparent from the following more particular description of preferred embodiments as illustrated in the accompanying drawings in which like reference characters refer to the same parts throughout the various views. The drawing is not necessarily to scale, emphasis instead being placed upon illustrating the principles of the invention.

BRIEF DESCRIPTION OF THE DRAWING

The drawing is a schematic illustration of a method and apparatus of this invention.

DETAILED DESCRIPTION OF THE INVENTION

The apparatus for obtaining energy from low BTU, low volatile content, low carbon and high ash fuels is schematically illustrated in the drawing. A shaft kiln combustor 2 is conventionally mounted at a fixed predetermined location and is conventionally constructed with water jacketed walls 4. A plurality of conduits 6 are used to supply combustion air to the shaft kiln combustor 2. A conduit 8 supplies the combustion air to the conduits 6. The amount of combustion air, or other oxygen-containing gas, must be sufficient to support combustion in the shaft kiln combustor 2 and a fluidized bed combustor (to be described below). The upper end 10 of the shaft kiln combustor 2 is provided with slanting walls 12 to form a venturi 14 so that the velocity of a mixture of air and combustion gases leaving the shaft kiln combustor 2 will be increased for a purpose described below.

A distributing means 16 is located directly above the venturi 14 and is used to distribute low BTU, low volatile content, low carbon and high ash fuels, which in the preferred embodiment is spent shale, into the venturi 14. The spent shale has a wide range of particle sizes, such as between about 0 to 3 inches. As described below, the spent shale distributed into the venturi is separated by the velocity of the mixture of air and combustion gases so that the spent shale in particle sizes less than about ¼ inch move with the mixture of air and combustion gases while the spent shale in particle sizes greater than about ⅜ inch move through the venturi and into the shaft kiln combustor 2 for combustion therein.

A fluidized bed combustor 18 is mounted directly above the distributing means 16 so that the moving mixture of air and combustion gases carrying the minus ¼ inch spent shale particles moves upwardly through the fluidized bed combustor 18 for combustion therein. As illustrated in the drawing, the cross-sectional area of the fluidized bed combustor 18 is substantially less than the cross-sectional area of the shaft kiln combustor 2 so that the exit of the venturi 14 adjacent to the fluidized bed combustor is significantly smaller than the entrance adjacent to the shaft kiln combustor 2. Therefore, the mixture of air and combustion gases, after passing through the narrowest portion of the venturi 14, will move through the fluidized bed combustor 18 at velocities sufficient to carry the finer sized particles therewith for combustion in the fluidized bed combustor. The fluidized bed combustor 18 is conventionally constructed with water jacketed walls 20. The gaseous products of combustion produced in the fluidized bed combustor 18 exit therefrom in a horizontal direction through opening 22 and then move downwardly so that a 180° change in the direction of movement is effected. As illustrated in the drawing, the inner surface 24 of the upper portion of the fluidized bed combustor 18 is generally semicylindrical in shape. This configuration causes the larger particles, still having some carbon content, to follow the inner surface and fall into the fluidized bed cooler 26 while the smaller sized particles move out with the gaseous products of combustion through section 28. The gaseous products of combustion carrying the finest particles entrained therein move out through the section 28 into a conduit 30. The lighter carbon containing particles will move out of the fluidized bed cooler 26 and move through passageway 32 into the venturi 14 for further combustion. The heavier non-carbon containing particles will move out of the fluidized bed cooler 26 and move through passageway 34 to be removed from the system because virtually all useful energy has been removed therefrom.

In the preferred embodiment of the invention water is used as the medium for converting the heat generated by the combustion of the spent shale in the shaft kiln combustor 2 and the fluidized bed combustor 18 into useful energy. In a system illustrated in the drawing, feedwater in conduit 36 enters into the conduit 30 and then follows a tortuous path during which it is preheated by the gaseous products of combustion in conduit 30 and section 28. The heated water is then fed into a steam drum 38 and then into the water-jacketed walls 4 and 20 where the heat generated by the shaft kiln combustor 2 and the fluidized bed combustor 18 is used to change the water into steam which is then fed into the steam drum 38. Steam exits from the steam drum 38 through a conduit 40 and, as illustrated in the drawing, follows a tortuous path in the upper portion of the fluidized bed combustor 18 before it is conveyed by conduit 42 to a location (not shown) where it is put to a useful purpose. Circulation of the steam in conduit 40 is provided to further raise the temperature and/or pressure of the steam for a desired end use.

The apparatus of this invention may also be utilized to raise the temperature of recycle gas to be used in the retorting process for the oil shale from which the spent shale for this invention is produced. As illustrated in the drawing, retort recycle gas in conduit 44 at a temperature of about 200° F. enters into section 46 and follows a tortuous path therein and exits through conduit 48 at a temperature of about 1000° F.

The method of obtaining energy from the spent shale will be described with the system in its operative condition. The shaft kiln combustor 2 is at an operating temperature of about 2000° to 2400° F. The mixture of air and combustion gases exiting from the shaft kiln combustor 2 pass through the venturi 14 wherein the velocity of the mixture of air and combustion gases is increased to about 90 to 110 feet per second and preferably to about 100 feet per second. Spent shale, in a size range of from fines to about 3.0 inches, is distributed into the venturi 14 above the narrowest portion thereof by the distributing means 16 where the spent shale is separated into two portions by the velocity of the moving mixture of air and combustion gases. A first portion comprises spent shale in particle sizes less than about $\frac{1}{4}$ inch which are entrained in the moving mixture of air and combustion gases to move into the fluidized bed combustor. A second portion comprises spent shale in particle sizes greater than about $\frac{3}{8}$ inch which move through the venturi 14 and fall onto the bed of combustibles in the shaft kiln combustor 2 to be combusted therein. In the shaft kiln combustor the larger particles are combusted while falling downwardly through the upward flow of air or other oxygen-containing gas such that high temperature gas is formed and contacted with heat exchange surfaces within the shaft kiln combustor 2 for heat recovery before exiting therefrom to the fluidized bed combustor 18. The downwardly falling large particles are cooled by the rising stream of oxygen-containing gas for further heat recovery and cooling of the larger particles, permitting removal of relatively cool combusted large particles from the bottom of the shaft kiln combustor. The combustion air or other oxygen-containing gas is fed into the shaft kiln combustor 2 through conduits 6 at a velocity of between about 10 to 20 feet per second and in amounts sufficient to support combustion in the shaft kiln combustor 2 and permitting an excess to flow with combustion gases through the venturi 14 into the fluidized bed combustor 18 to support combustion therein.

The first portion of spent shale particles moves with the mixture of air and combustion gases upwardly into the fluidized bed combustor 18 to be combusted therein. The temperature in the fluidized bed combustor 18 is between about 1800° and 2000° F. and the velocity of the mixture of air and combustion gases is from about 40 to 60 feet per second. At the top of the fluidized bed combustor 18, the products of combustion are moved through a 180° change in direction. These products of combustion have some solid particles entrained therein. The finest of these particles move with the products of combustion through section 28 and conduit 30 to further heat recovery means and solids removal equipment, such as a bag house (not shown). The larger particles fall into the fluidized bed cooler 26 from which the lighter carbon-containing particles are fed back into the venturi 14 while the heavier non-carbon containing particles are removed from the system. As described above, the heat generated by the combustion of the spent shale particles in the shaft kiln combustor 2 and the fluidized bed combustor 18 is used to convert the water in the water jacketed walls 4 and 20 into steam which can be used as desired. Also, as described above, the generated heat is used to raise the temperature of recycle gas for use in the retorting process.

In the preferred embodiment of the invention, the spent shale is the solids discharged from the final retort stage of a process for obtaining useful products from oil shale. The spent shale is at a temperature between about 850° to 950° F. when it is distributed into the venturi 14. Although the spent shale is preferably at the foregoing temperatures, it is understood that the method and apparatus of this invention may be used to obtain energy from spent shale or any low BTU, low volatile content, low carbon and ash fuels at other temperatures.

The above described operation permits the introduction of materials such as spent shale into a combustion and heat recovery unit that is capable of handling both extremely small particle size material as well as relatively large particle size material without the need to separate the large from the small particles by screening, followed by the separate treatment of the large and small particles; or, without the necessity of grinding the larger particles into relatively small particles, with its concomitant heat loss, before processing all as small particles. The interconnection of the shaft kiln combustor to the fluidized bed combustor by means of the venturi permits the same volume of gas from the shaft kiln combustor to be increased in velocity sufficient to entrain the smaller-sized particles for movement into the fluidized bed combustor. Additionally, the heated gas from the shaft kiln combustor provides additional heat needed to sustain combustion in the fluidized bed combustor without the necessity of externally fueled heaters.

While the preferred embodiments of the invention have been illustrated and described herein, it may be otherwise embodied and practiced with the scope of the following claims.

What is claimed is:

1. A process for obtaining energy from a low BTU, low volatile content, low carbon and high ash fuel using a first combustor having an exit end and a second combustor having an entrance end, comprising:

providing quantities of a low BTU, low volatile content, low carbon and high ash fuel having various particle sizes;

forming a passageway between the first combustor and the second combustor by connecting the exit end of the first combustor and the entrance end of the second combustor together;

introducing the quantities of fuel into said passageway;

moving a gaseous stream through said passageway at a velocity sufficient to separate the quantities of fuel into finer particles and coarser particles;

combusting the coarser particles in the first combustor to generate heat;

combusting the finer particles in the second combustor to generate heat; and using the generated heat to provide useful energy.

2. A process, as claimed in claim 1, wherein said moving step includes:

moving the coarser particles into the first combustor; and entraining the finer particles in the gaseous stream for movement therewith into the second combustor.

3. A process, as claimed in claim 1, wherein said combusting steps include:

introducing an oxygen-containing gas into the first combustor in a quantity sufficient to provide adequate oxygen to support combustion in both the first combustor and the second combustor.

4. A process, as claimed in claim 1, wherein the providing step includes:

using spent shale as the quantities of fuel.

5. A process, as claimed in claim 1, wherein using a shaft kiln combustor as the first combustor; and using a fluidized bed combustor as the second combustor.

6. A process, as claimed in claim 5, wherein:

using gaseous products exiting from the shaft kiln combustor as said gaseous stream; and using a venturi in said passageway so as to increase the velocity of said gaseous stream to said sufficient velocity.

7. A process, as claimed in claim 4, wherein:

introducing the spent shale at a temperature in excess of 800° F.

8. A process, as claimed in claim 1, wherein:

the finer particles are less than about $\frac{1}{4}$ inch; and the coarser particles are greater than about $\frac{3}{8}$ inch.

9. A process, as claimed in claim 6, wherein the moving step includes:

moving said gaseous stream at a velocity between about 90 and 110 feet per second.

10. A process, as claimed in claim 9, wherein:

operating the shaft kiln combustor at a temperature between about 2000° and 2400° F.; and operating the fluidized bed combustor at a temperature between about 1800° and 2000° F.

11. An apparatus for obtaining energy from a low BTU, low volatile content, low carbon and high ash fuel using a first combustor having an exit end and a second combustor having an entrance end, comprising:

mounting means for mounting the second combustor to the first combustor;

means forming a passageway between the exit end of the first combustor and the entrance end of the second combustor;

inlet means for introducing quantities of the low BTU, low volatile content, low carbon and high ash fuel into said means forming said passageway;

means for providing a moving gaseous stream through said means forming said passageway, said gaseous stream moving at a velocity sufficient to separate the quantities of fuel into finer particles and coarser particles whereby said coarser particles can then move to the first combustor to generate heat and said finer particles can then move to the second combustor to generate heat; and means responsive to said generated heat to provide useful energy.

12. An apparatus, as claimed in claim 11, wherein:

the quantities of fuel comprise spent shale.

13. An apparatus, as claimed in claim 12, wherein:

the first combustor comprises a shaft kiln combustor; and the second combustor comprises a fluidized bed combustor.

14. An apparatus, as claimed in claim 13, wherein:

said means forming a passageway and said means for providing a moving gaseous stream include a venturi to increase the velocity of the gaseous products exiting from the shaft kiln combustor.

15. An apparatus, as claimed in claim 14, wherein:

the quantities of fuel comprise spent shale.

16. An apparatus, as claimed in claim 15, wherein:

the spent shale is at a temperature greater than about 800° F. when introduced into said means for forming said passageway.

17. An apparatus, as claimed in claim 15, wherein:

the finer particles are less than about $\frac{1}{4}$ inch; and the coarser particles are greater than about $\frac{3}{8}$ inch.

18. An apparatus, as claimed in claim 17, wherein:

the temperature in the shaft kiln combustor is between about 2000° and 2400° F.; and the temperature in the fluidized bed combustor is between about 1800° and 2000° F.

19. An apparatus, as claimed in claim 18, wherein:

said useful energy provided is steam.

* * * * *